United States Patent [19]

Pidcock

[11] Patent Number: 5,057,070

[45] Date of Patent: Oct. 15, 1991

[54] APPARATUS FOR FOLDING AND COMPACTING A LARGE DIMENSION DOCUMENT

[76] Inventor: Ralph Pidcock, 2614 Greenleaf St., Allentown, Pa. 18104

[21] Appl. No.: 603,928

[22] Filed: Oct. 26, 1990

[51] Int. Cl.[5] ..... B65H 45/04

[52] U.S. Cl. ..... 493/405; 283/34

[58] Field of Search ..... 283/34, 35; 493/405, 493/953; 33/1 B, 474, 476, 562, 566

[56] References Cited

U.S. PATENT DOCUMENTS

| | | | |
|---|---|---|---|
| 747,085 | 12/1903 | Rieffel | 493/405 |
| 1,463,605 | 7/1923 | Walters | 33/476 |
| 1,809,000 | 6/1931 | Stealy | 493/405 |
| 3,241,829 | 3/1966 | Acher | 493/496 X |
| 4,360,346 | 11/1982 | Ehsanipour | 283/34 X |
| 4,443,198 | 4/1984 | Ehsanipour | 283/34 X |
| 4,826,212 | 5/1989 | Muth et al. | 493/162 X |

FOREIGN PATENT DOCUMENTS

| | | | |
|---|---|---|---|
| 0021338 | 2/1980 | Japan | 493/405 |

*Primary Examiner*—Frederick R. Schmidt
*Assistant Examiner*—John A. Marlott
*Attorney, Agent, or Firm*—Sanford J. Piltch

[57] ABSTRACT

A multipurpose template for folding oversized variable linear dimensioned documents, prints or plans adapted to fit over a vertical support surface, such as a room or closet door, which provides two perpendicularly oriented alignment elements fixedly secured to a planar folding surface. The alignment elements display fold line locating indices and sets of graphic pattern folding instructions for folding said oversized documents to a size suitable for mailing or storage with the resulting folded document displaying the legend or title block on the upward facing plate or segment of the folded document. The template also provides a surface for temporary writing with erasable marker, a screen for viewing projected images, and a guide for cutting and trimming such oversized documents.

9 Claims, 2 Drawing Sheets

2
2
14
16
18
20
22
24
26
28
30
32
34
40
12
10
56
58
PRINT SIZES
TITLE BLOCK POSITION
18x24
24x30
24x36
30x42
36x48
6
8
9
10
12
8
9
10
12
FOLDING INSTRUCTIONS
Linear Right Title Block
Centered Title Block FOLDING INSTRUCTIONS
LOWER RIGHT TITLE BLOCK
FOLD
PRINT FACE DOWN
ALIGN
CENTERED TITLE BLOCK
PRINT SIZES
TITLE BLOCK POSITION
18 X 24
24 X 30
24 X 36
30 X 42
36 X 48

APPARATUS FOR FOLDING AND COMPACTING A LARGE DIMENSION DOCUMENT

TECHNICAL FIELD

This invention relates to an improved apparatus for folding large-dimension, flexible sheet documents. In another aspect, it relates to a document folding template adapted to further serve as an erasable information recording surface.

BACKGROUND OF THE INVENTION

Technical drawings, like architectural plans and engineering blueprints, are the chief working papers in building design and in many other industrial design activities. Part of their use pattern is the need for the folding of such large dimension documents for storage in file cabinets, and for their ready insertion and dispatch in standard sized mailable envelopes. When such drawings are folded or compacted, the title or information legend block is generally desired to appear on the outermost panel of the newly folded document. This is desired whether or not the information legend was originally located in the lower right hand corner, or was placed elsewhere on the document margin.

Given the variability in document dimensions, and the like variation in the document legend placement, a plethora of folding pattern sequences so as to compact a document to mailing envelope size, preferably as noted with the top panel having the title legend, are created.

Heretofore, formed board templates, and the like, have been used to make the multiple folds and to speed the work of compacting for storing or mailing. Folding devices now available are unduly complicated to master, or leave too much to the discretion of clerical personnel in meeting the stated goals for document compaction. One elaborate device for folding large sheet documents or foils is a machine requiring reciprocating folding sticks, which is described in U.S. Pat. No. 3,241,829 [Acher].

Another mechanized approach is shown in the sheet folding method and apparatus of U.S. Pat. No. 4,826,212 [Muth]. This involves fabricating from tailored plate elements (of somewhat variable configuration) a planar mosaic that constitutes an upper and lower folding template. The variable size plate elements then correspond to preset fold configurations desired to be impressed into the sheet-like document. This is a complicated and limited scope solution to large document overall size reduction.

It is therefore an object of the invention to provide an uncomplicated device that is readily fabricated, and which will permit handy reduction into compacted formats suitable for either filing or mailing, of large-dimension technical documents, which are not functionally useful in only reprographically reduced layouts.

Another object is to provide an ambulatory document folding device which can be interruptably mounted at a plurality of sites, and is also adapted to compacting flexible documents of a wide range of size dimensions.

A further object of this invention is to not only provide an article for document compacting, but one which can conveniently serve for information inscription on a board having an erasable surface, similar in practice to the schoolroom blackboard and chalk.

These and other advantages of the invention will become apparent from the following description of a currently preferred embodiment, and from the claims and drawings.

SUMMARY OF THE INVENTION

The present invention serves to overcome the shortfalls of known folding devices and methods with a facile device that is easy to construct and utilize, and which can be readily adapted to widely-variable document sizes and for effecting differing folding configurations. In accordance with the invention, a unique article of manufacture is provided which is precisely adapted for accomplishing the compaction by multiple foldings of large dimensional-size, flexible sheet documents into a folded format, then suitable for cabinet filing, or for insertion into any one of a variety of standard-sized mailing envelopes.

The device comprises a formed and essentially rigid, conveniently-rectangular planar board of a nominal thickness, but which is sufficient to preclude bending during use. It is tailored to be interruptably suspended on its reverse side proximal to a vertically-oriented supporting surface. Along the upper transverse edge of the planar board, there is secured a first ruler-shaped component, that is usually dual linearly-edged, and is fixedly secured to and aligned uniformly to said edge by overlapping along its longitudinal axis the upper horizontal margin of the frontal surface of the planar board. This first ruler-shaped component or straight edge is adapted to have its inwardly disposed, longer dimension oriented so as to be substantially parallel to the transverse dimension of the board. A first set of instructional graphics are arrayed along the outer surface of the first straight edge to instruct the user of the location of suitable folding lines for each of several varying dimension documents by graphical simulations.

At right angles to the first straight edge, and spaced slightly apart therefrom, is the converging longitudinal end of a second ruler-shaped component or straight edge. This straight edge is positioned on the left vertical margin of the board. This placement is suitably appropriate for not only the predominately right-handed users, but also for left-handed users. The vertically oriented straight edge, which is also dual linearly-edged, is also fixedly secured to an overlapping lateral margin. The inwardly disposed, longer dimension, is oriented so as to also substantially parallel the boards lateral edge and be at a right angle to the first ruler-shaped component.

A second set of instructional graphics are displayed along the outer face of the second straight edge arranged from top to bottom. These graphics instruct a user in document folding sequences, with such sequences being based on the document size and the location of the document title or information legend and whether the user is right-handed or left-handed. In most cases the graphics provide common options for folding along the lines prescribed where the title or information legend is found either in the lower right or lower central panel of the flat, full-scale document.

A convenient method of temporarily attaching the invention to a flat support surface is by using suspending hook accessories appended to the upper edge of the planar board which permits the board to be removably suspended on any of a plurality of inner doors for document folding purposes. Consistent with this mode of use of door suspension, the lowermost segment of the planar board is of a somewhat reduced transverse dimension, so that the device may be readily suspended flush to a door, but avoiding any interference with a projecting doorknob or handle. In a second embodiment, the invention can be adapted to be permanently mounted on an office wall by the use of mounting screws.

BRIEF DESCRIPTION OF THE DRAWINGS

For the purpose of illustrating the invention, there are shown in the drawings modes which are presently preferred; it being understood, however, that the invention is not limited to the precise arrangement and features shown.

DETAILED DESCRIPTION OF THE INVENTION

Figure 1:
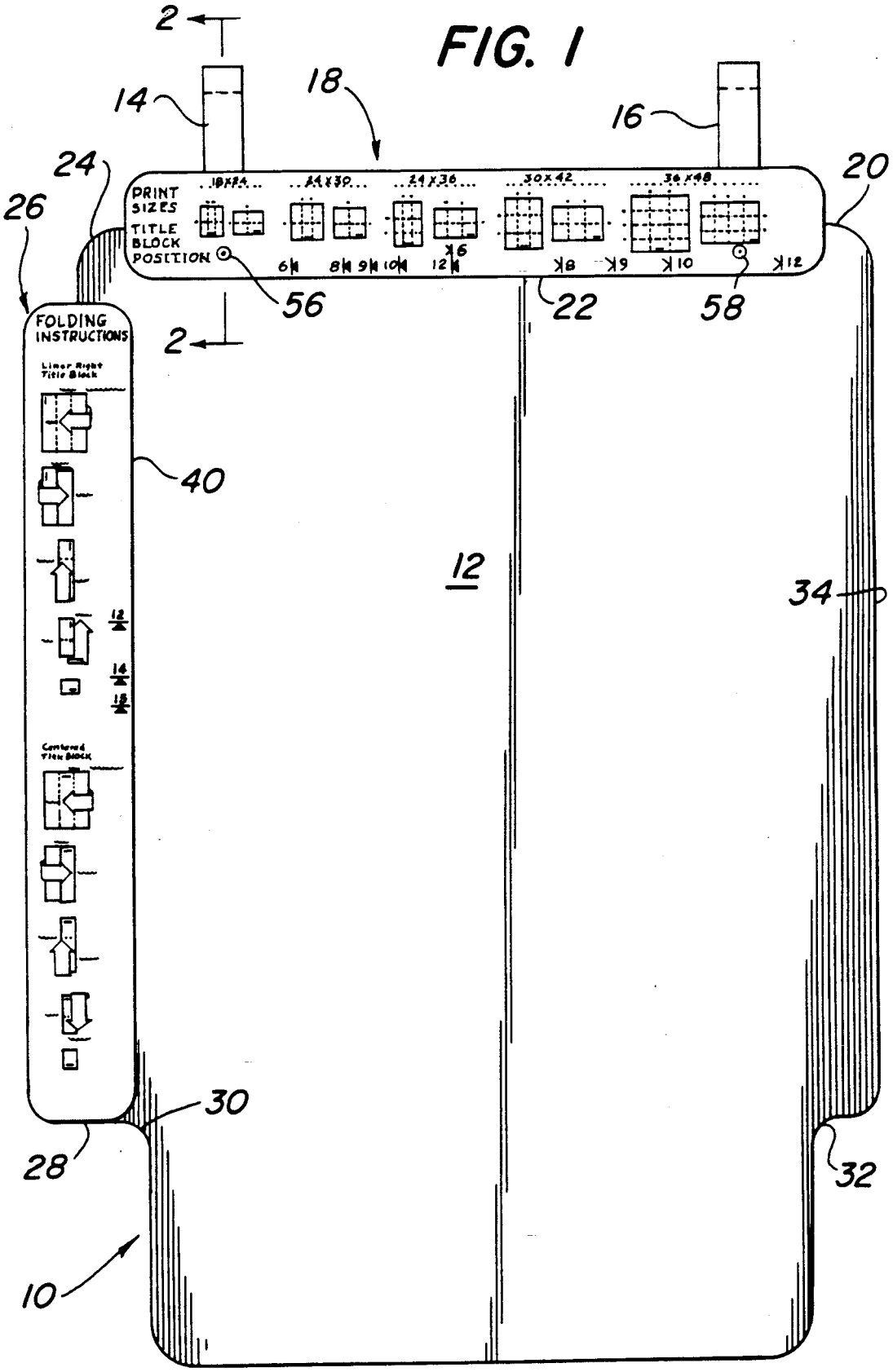
FIG. 1 is an elevational view of the display and functional surface of the device of the present invention, as it would be assembled and positioned for mounting on a vertical support means.

The following detailed description is of the best presently contemplated modes of carrying out the invention. This description is not intended in a limiting sense, but is made solely for the purpose of illustrating the general principles of the invention.

Referring now to the drawings in detail, wherein like numerals designate like elements or parts, there is depicted the fully assembled device of the present invention, generally 10, as it would be configured for suspending on a vertical support means, such as a knobbed door (not shown). The device is comprised of a generally rectangular planar board 12 with its longer dimension disposed vertically, and being suspended from offset hooks 14, 16. A first straight-edge alignment element 18 is centered along the horizontal dimension of the board 12 and aligned to be overlapping and affixed to the upper margin or edge 20 of the board 12. The first straight-edge alignment element inwardly facing edge 22 is ideally horizontal with a level along its upper edge to eliminate the catching of documents against the edge as they are folded. Offset from the first straight-edge alignment element 18 and positioned along the left vertical side 24 of the board 12 is a second straight-edge alignment element 26. This second alignment element is centered along the vertical dimension of the board and overlapping the left side edge or margin 24 of the board. The second alignment element 26 also has a similar level edge to serve the identical purpose during folding. In the depicted embodiment, the lower end 28 of the second alignment element 26 coincides with a recessed shoulder 30 of the lower, narrower segment of the board 12. A like recessed shoulder 32 is provided in the opposing right side 34 of the board for purposes to be later described. Similarly, the character and function of the distinct graphics and printing on the two alignment elements 18, 26 will be detailed in relation to FIGS. 3 and 4.

Figures 2, 3, 4:
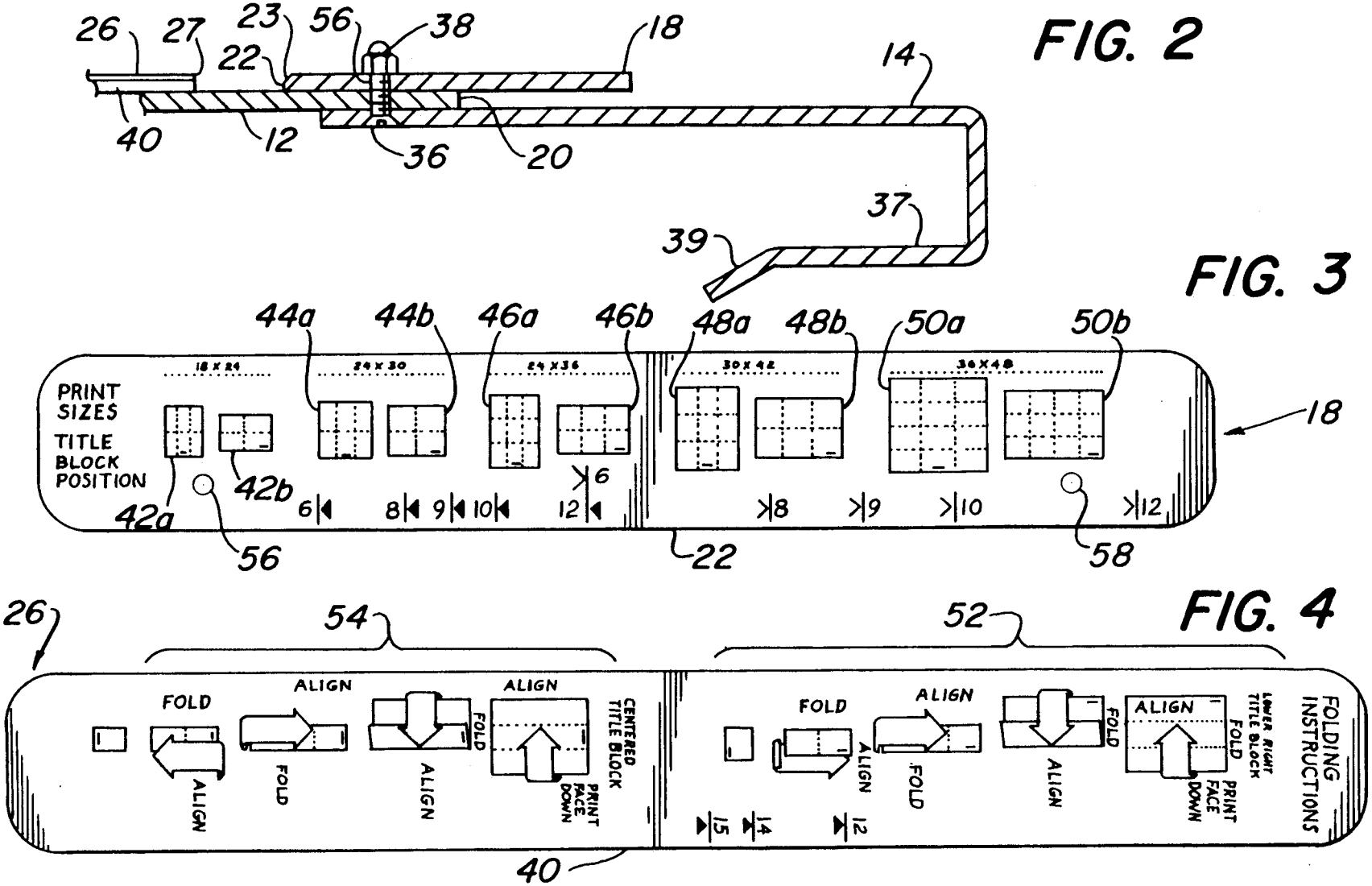
FIG. 2 is a partially broken away side view in vertical section, taken along line 2—2 of FIG. 1 of the invention, which depicts the upper segment of the invention showing the overlapping and conjoined alignment of the mated elements.
FIG. 3 is an enlarged view of the horizontally disposed straight edged alignment element of the invention which is imprinted with a set of graphical illustrations of typical large-dimension documents showing proposed folding lines.
FIG. 4 is an enlarged view of the vertically disposed straight edged alignment element which is also imprinted with a set of graphical illustrations and instructions for the folding of large-dimensioned documents.

A vertical sectional view of the assembled device of the present invention is shown in FIG. 2. Screw 36 is placed through properly aligned and cooperating bore holes in the suspending hook 14, the board 12 and the first alignment element 18 to hold the hook and alignment element fast to the board by threading engagement into the cap nut 38. The screw 36 preferably is placed through the cooperating holes from the rear of the board with a countersunk hole in the suspending hook 14 so that the screw 36 does not protrude from the hook and possibly cause damage to the underlying support surface of the door (not shown). The screw 36 terminates in a threaded portion which mates with cap nut 38 which overlies the alignment element 18 when tightened down. A similar configuration of elements anchors the other side of the board 12. Alternatively, a rivet or other type similar fastening device can be used to secure and hold aligned the named elements.

The placement of the two alignment elements 18, 26 is accomplished primarily by gluing, cementing and the like the undersurface of the alignment elements 18, 26 to the surface of the board in the appropriate locations and in the required configuration. Alternative methods of permanently affixing the two alignment elements 18, 26 to the board 12 which are presently known or hereafter discovered may also be used.

The suspending hook 14 is configured to overlie the top edge of a door to a room or a closet. The rounded corners of the top of the hook and the flat extension between them are dimensioned so as to fit snugly over the top edge of the door without producing additional clearance problems. The depending distal end 39 of hook 14 is angled outward away from the board 12 and the door (not shown). This provides for ease of mounting and demounting of the folding device from its underlying support surface. The hook 14 may also have its rear clamping element 37 angled inward slightly (rather than parallel to the front of the hook as shown) to provide a greater clamping action to the underlying support surface. The angling inward of the clamping element 37 will also provide a means of securely mounting the folding device to support surfaces having a narrower depth dimension than the maximum depth dimension permitted by the hook 14.

The uppermost end of the second alignment element 26 is shown with its inwardly facing aligning edge 40 facing outward from the drawing. The drawing shows the leveling of the upper portion of the edge 40 to eliminate the catching of the document edges in the alignment element 26 during compaction. The second alignment element 26 is offset vertically from the inwardly facing aligning edge 22 of the first alignment element 18. Note that these elements are conveniently fabricated from materials of more or less the same thickness, though this is a matter of no special moment. Both the horizontal and vertical alignment elements 18, 26 should have sufficient depth to retain multiple folds of the large document cornered in place between them during the plural folding steps.

Referring to FIG. 3, a description of the graphics and printed instructions on the first alignment element 18, the upper, horizontal straight edge, follows. The graphics and printed instructions function primarily to instruct a user of the folding device of the present invention on the location of appropriate fold lines for large-dimension documents and the steps for folding such documents to acceptable sizes for storage or mailing. While architectural plans, engineering drawings and the like are usually of rectangular configuration, such documents vary considerably in overall size and dimensions.

Describing the graphics which appear on the straight edge 18, the document or print sizes are lettered across the top margin of the straight edge 18 with the legend or title block position shown across the middle of the straight edge which includes a suggested folding pattern. Beginning at the far left, a pair of graphics 42*a*, 42*b* depict a document or print size of 18"×24". The left hand graphic of this pair shows the print having a longer vertical dimension and the right hand graphic shows the print having a longer horizontal dimension. Depending upon the position of the legend or title block in the document margin, i.e. centered or in the lower right corner, the document may be conveniently folded in accordance with one of the two suggested folding patterns shown as dotted lines in the graphics. The ultimate folded size of the documents are designed to fit into standard size mailing envelopes, i.e. 9"×12", 10"×15", and 12"×15", or into file folders, either letter or legal size.

Proceeding rightward, there are next shown three intermediate sizes of documents on the straight edge 18. The next larger print size 24"×30" is depicted by another pair of graphics 44*a*, 44*b*. Of this group the next larger print size 24"×36" is depicted by the next rightward pair of graphics 46*a*, 46*b*. The last of this group, the print size 30"×42" is depicted by the next pair of graphics 48*a*, 48*b*. As in the case of the graphics pair 42*a*, 42*b*, each of the pairs of graphics 44*a*, 44*b* through 48*a*, 48*b* the left hand graphic shows the print having a longer vertical dimension and the right hand graphic shows the print having a longer horizontal dimension. Again, depending upon the position of the legend or title block in the document margin, the document may be conveniently folded in accordance with one of the suggested two folding patterns shown as dotted lines in the graphics.

Lastly, the largest size document 36"×48" is depicted by a pair of graphics 50*a*, 50*b* on the far right end of the straight edge 18. This graphics pair 50*a*, 50*b* again shows the print having a longer vertical dimension as the left hand graphic and the print having the longer horizontal dimension as the right hand graphic. The suggested folding lines are also shown each of the graphics 50*a*, 50*b* with the folding lines (shown as dotted lines) laid out in accordance with the legend or title block being centered or located in the lower right corner.

Arrayed along the inwardly facing linear edge 22 of the straight edge 18, beginning from the left end, are a first group of a plurality of numerals, 6, 8, 9, 10 and 12, which are spaced along the straight edge 18 in accordance with the actual linear measurement (in inches) the numerals represent. The numerals are marked along the lower margin of the straight edge 18 immediately adjacent to the linear edge 22. These numerals are also replicated in linear sequence in a second group, in a different spaced relationship but representative of the actual linear measurement which they represent. This second group of numerals is marked on the lower margin of the straight edge 18 also immediately adjacent the linear edge 22, but farther to the right. These numeric indices serve to indicate the position of vertical fold lines for a print or document. The particular position of the fold line is directly related to the positioning and alignment of the document or print against the left side vertical straight edge 26. The solid arrows are to be used with right-handed folding directions and the open arrows are to be used with left-handed folding directions. These solid and open arrows, which appear in conjunction with the numerals, will be discussed later in regard to specific folding instructions.

Referring to FIG. 4, the left side (vertically oriented) straight edge 26 is depicted which shows two methods of folding a print or document. Each of the two methods is applicable to the folding of a print or document having either a lower right corner or centered legend or title block. The displayed graphics, the lower right corner group 52 and the centered group 54, describe the steps for folding prints or documents having either a centered or cornered legend or title block which faces toward the board 12 for proper folding. Approximately midway along the inwardly facing linear edge 40 is located a group of numerals, 12, 14 and 15. These numerals are marked on the face of vertical straight edge 26 immediately adjacent the linear edge 40. The numeric indices serve to indicate the position of horizontal fold lines for a print or document. As in the case of the horizontal straight edge 18, the particular position of the fold line is directly related to the positioning and alignment of the document or print against the top horizontal straight edge 18. The triangle marks which appear in conjunction with the numerals will be discussed later in regard to specific folding instructions.

The graphics 52, 54 displaying flat and folded prints or documents with guide arrows and instructional wording denote the sequence preferred to achieve a folded print or document from its flat form of initial variable dimensions to a folded or compacted form, with the legend or title block appearing on the topmost panel of the folded document or print.

Returning to FIG. 1, with regard to the outward facing surface of planar board 12, this surface can be adapted to provide an erasable information recoil surface. The outward face of board 12 can be constructed such that a high-gloss surface is laminated thereto which extend under the superimposed straight edges 18, 26. Such smooth facades are known in the art, and lend themselves to inscription with India ink or dry erase markers, the markings from which are readily removed by a moist cloth. Such characteristics are the contemporary versions of the schoolroom blackboard chalk and felt eraser. Thus, a supplemental vertically oriented temporary large writing surface can be provided.

The board 12 may also be utilized to display projected images from slide projectors, overhead projectors, and the like. The generally white surface of the board is aptly suited to reflect projected images in a location where a standard projection screen can not be utilized.

Lastly, the device can be quickly converted into a support template for large document trimming. A large document can be aligned against the top horizontal straight edge 18 with the area of the document to be trimmed extending beyond the right edge 34 of the board 12. The right edge 34 will then act as a cutting guide (straight edge) for cutting or trimming the document with a razor knife or like instrument. Thus, a third supplemental use is described providing a surface and guide for cutting and trimming prints or documents.

The folding device 10 of the present invention can have the linear dimensions in the range of 30" to 36" (in the horizontal direction) and 36" to 48" (in the vertical direction), with the preferred minimum thickness of approximately ¼" for the planar board 12 and also for the straight edges 18, 26. As a matter of design aesthetics and of user safety, the rectangular corners of the planar board and of both straight edges can be beveled or rounded in the fabrication process. The recessed shoulders 30, 32 are provided to accommodate left or right side door knobs or pulls so that the folding device 10 will lay flat against the underlying support surface, the room or closet door.

Alternately, the folding device 10 may be permanently mounted to a wall or room partition using screws or bolts placed through the holes 56, 58 formed from the corresponding alignment of the holes drilled through the planar board 12 and the straight edge 18. The left side vertical straight edge 26 may be held fixedly in place by a like arrangement of a recessed screw and cap nut, as in the case of the support hooks 14, 16, or by the previously described gluing or cementing of the underside of the straight edge 26 to the board 12.

To use the folding device 10 after it has been mounted, either temporarily or permanently, one steps up to the mounted folding device and determines which set of instructions will apply to the print or document (comparing the dimensions and the placement of the legend or title block). For the purposes of this explanation a document sized 24"×36" will be used as the model. One first locates the particular graphic displayed along the top horizontal straight edge 18 which matches the document size and legend or title block placement. In this case it will assume that graphic **46*a* accurately depicts the document to be folded. Next the particular graphic displayed along the left side vertical straight edge 26 which matches the placement of the title block is located. In this case, due the prior assumption of the print size, orientation and legend or title block location, graphic set 54** will be used.

Once the graphic models have been located, the document to be folded is placed face down against the board in the prescribed orientation with its upper edge aligned against the straight edge 18 and its left edge aligned against the straight edge 26. While holding the document firmly to the board with the left hand, the other hand takes the "free" right side of the document and, following the folding instructions of graphic set 54, aligns the edge of that side with the prescribed numeral calibration on the top horizontal straight edge 18 of the folding device 10. In this case, since the horizontal dimension of the document against the board 12 is 24", the right side document edge will be aligned with the numeral 8 (having the arrow located to the right of said number with the apex pointing to the left). The number set having such "filled in" arrows associated with it are used for folding documents which have free right sides and use the left side as a fixed measurement point for the fold lines. The numeral 8 was selected because the horizontal dimension of the document on the board 12 is 24" and the graphic set 54 requires a tri-fold folding process (creating equal by dimension folded segments) for a document exhibiting said dimensions.

After aligning the right edge of the document with the numeral 8, and while the document is retained in alignment along its top edge against the straight edge 18 with the one hand, the other hand is drawn up or down across the document creating a linear crease at the desired point such that a fold is made in the document allowing the right one third of the document to overlay the left two thirds of the document as shown in graphic set 54. The next step is to, again, return the document after folding in alignment against the straight edge 18 and fold the left one third of the document over the previously folded right one third of the document as shown in the graphic set 54. Thus, remaining is one third of the horizontal dimension of the document with its left edge aligned with the numeral 8 and the legend or title block facing against the board 12. The same creasing step is to be effected as many times as the instructions direct, always "aligning" the free edge of the document with the appropriate calibration to produce the final desired size and configuration for the folded document.

Continuing with the folding example, the horizontal folds along the vertical direction must now be made. The third of the graphics of graphic set 54 depicts the tri-folded document and instructs that a new fold be made along the transverse dimension. The vertical dimension of the example document is 36" and the graphic set 54 is providing instructions for another required tri-fold folding process. The partially folded document is again aligned, in its partially folded form, against both straight edges 18, 26. Once properly aligned, the document lower "free" edge is brought up and aligned with the numeral 12 along the linear edge 40. The associated arrow with the upward pointing apex indicates that the number set is to be used with documents whose alignment stems from its upper left hand corner.

Once the lower edge of the document is aligned with the number 12 and held in place by one hand, the other hand is drawn left and right across the transverse dimension of the document creating a linear crease at the desired point such that a fold is made in the document allowing the bottom one third of the document to overlay the top two thirds of the document as shown in graphic set 54. Next, the top one third of the document is folded over the bottom one third of the document in similar fashion as to that done previously with the right and left thirds of the document. This results in the completely folded document with the legend or title block appearing on the top folded segment of the document. Hence, in accordance with the linear dimensions of the example document, two sets of tri-fold folding steps, taken in the appropriate sequence, have resulted in the complete folding of the example document to a folded size of 8"×12", with the legend or title block viewable in the complete folded form.

Although all right-handed users and most left-handed users will find the graphic instruction sets easy to use, a left-handed set of arrows have been placed in the first straight edge 18 to facilitate folding from left to right. In this case the legend or title block would be placed at the bottom or lower right corner facing the planar board 12. The vertical folding instructions inverted to achieve the viewable legend or title block in the complete folded form.

The graphic sets 42, 44, 46, 48, 50, 52 and 54 can be used to accomplish the desired folding to achieve a smaller sized folded document or print having a viewable legend or title block in any appropriate combination for any of the variety of differently dimensioned documents, prints or plans. In some instances, one of the folding steps may need to be skipped when the linear dimension requires only a bi-fold to be within the maximum range of the linear dimensions of the folded document; between 6"×12" to 12"×15". The folded document sizes easily fit into the variety of standard envelope sizes, as set forth above, or for placement in files.

Thus, the folding device of the present invention provides a vertical surface for the folding of a variety of differently sized linearly dimensioned documents freeing horizontal surfaces reserved for folding such large dimensioned documents for other uses. Additionally, the present invention also provides a flat writing surface for temporarily placing written information using erasable markers and the like. Further, the present invention also provides a vertical cutting or trimming means for use with large dimensioned documents not easily manageable or maneuverable on flat surfaces. The invention can also provide a flat screen for viewing projected images. Each of these objects of the invention have been described in sufficient detail above to enable one skilled in the art to completely understand the invention.

The present invention may be embodied in other specific forms without departing from the spirit or essential attributes thereof, and accordingly, reference should be made to the appended claims, rather than solely to the foregoing specification, as better indicating the scope of the invention.

What is claimed is:

1. A template for facilitating the folding and compaction of a large dimension document, print or plan into a folded form suitable for storage or insertion into conventionally sized mailing envelopes comprising:

(a) a formed and essentially rigid, substantially rectangular, planar board of a nominal thickness adapted to be mounted on its reverse side to a vertically oriented support surface;

(b) a first straight edge alignment means which is fixedly secured to and partially overlaps the top horizontal margin of the front surface of the underlying planar board, said first alignment means oriented such that its inwardly disposed, transverse edge is substantially parallel to said board margin;

(c) a first set of markings displayed upon said first alignment means which markings function to instruct the location of suitable folding lines for large variably dimensioned documents having rectangular linear dimensions;

(d) a second straight edge alignment means which is fixedly secured to and partially overlaps one of the opposing vertical margins of the front surface of the underlying planar board, said second alignment means oriented such that its inwardly disposed, transverse edge is substantially parallel to said one of the vertical board margins and perpendicular to the inwardly disposed edge of said first alignment means;

(e) a second set of markings displayed upon said second alignment means which markings function to instruct a document folding sequence for said large variably dimensioned documents, said folding sequence being contingent upon the document size and location of the legend or title block, whereby said large variably dimensioned documents may be folded in accordance with said first and second sets of markings resulting in a folded document having the legend or title block in a visible position upon the uppermost document plate or segment upon the completion of the folding steps.

2. The template of claim 1 wherein a suspending means is provided and affixed to the reverse side of said planar board, said suspending means comprises a pair of spaced-apart, hooking means adapted to interruptably slip over the upper horizontal edge of an underlying, vertically disposed support surface.

3. The template of claim 2 wherein the lowermost segment of the planar board is of a somewhat reduced transverse dimension, so that said board may be mounted on said vertically oriented support surface, such as a room or closet door, without interference with projecting knobs or pulls.

4. The template of claim 1 wherein said first set of markings includes a plurality of spaced-apart numbered indices having vertically aligned indications of the location of fold lines for the folding of a correspondingly sized document in a particular sequence.

5. The template of claim 1 wherein said second set of markings includes a plurality of spaced apart numbered indices with associated arrow-like indicators having horizontally aligned indications of the location of fold lines for the folding of a correspondingly sized document in a particular sequence, said folding sequence dependent upon the placement of the legend or title block in the margin of the document.

6. The template of claim 1 wherein the surface of the planar board which is located between the perpendicularly oriented first and second alignment means is adapted to accept erasable, informational writings.

7. The template of claim 1 wherein the planar board is adapted to serve as a support and guide means for the size reduction of large dimensioned documents by cutting or trimming along the other opposing vertical margin.

8. The template of claim 1 wherein the planar board is adapted to serve as a screen for viewing projected images.

9. The template of claim 1 wherein the first and second straight edge alignment means further comprise an upper inwardly facing beveled edge to minimize tearing and catching of documents during folding.

* * * * *